US005711355A

United States Patent [19]

Kowalczyk

[11] Patent Number: 5,711,355

[45] Date of Patent: Jan. 27, 1998

[54] PORTABLE LIQUID TRANSFER CONTAINER AND DISPENSING NOZZLE WITH NON-MOVABLE PART FREE FLOW, VAPOR RECOVERY AND OVERFILL PREVENTION SYSTEM

[76] Inventor: John Francis Kowalczyk, 8421 SW. 47th Ave., Portland, Oreg. 97219

[21] Appl. No.: 629,527

[22] Filed: Apr. 9, 1996

[51] Int. Cl.[6] ..... B67D 3/00

[52] U.S. Cl. ..... 141/382; 141/59; 141/290; 141/319; 222/479; 222/482

[58] Field of Search ..... 141/59, 285, 290, 141/319, 320, 382; 222/479, 481.5, 482

[56] References Cited

U.S. PATENT DOCUMENTS

| | | | |
|---|---|---|---|
| 932,026 | 8/1909 | Keller | 222/479 |
| 1,454,803 | 5/1923 | Wells | 222/482 |
| 1,849,950 | 3/1932 | Murdock | 141/382 X |
| 1,952,437 | 3/1934 | Huber | 141/285 X |
| 1,970,629 | 8/1934 | Scott | 141/382 X |
| 3,125,135 | 3/1964 | Boyer et al. | 141/290 |
| 3,139,123 | 6/1964 | Lisciani | 141/319 X |
| 3,217,948 | 11/1965 | Mullen | 222/479 |
| 3,683,978 | 8/1972 | Jones et al. | 141/285 |
| 3,746,200 | 7/1973 | Flider | 222/482 |
| 3,901,417 | 8/1975 | Schiemann | 222/479 |
| 3,996,978 | 12/1976 | Rapaelian | 141/285 |
| 5,058,636 | 10/1991 | Simmel et al. | 141/290 X |
| 5,474,112 | 12/1995 | Carola | 141/290 X |
| 5,538,165 | 7/1996 | Frohn | 222/479 |

*Primary Examiner*—J. Casimer Jacyna
*Attorney, Agent, or Firm*—John Smith-Hill

[57] ABSTRACT

A non-movable part portable liquid transfer container with dispensing nozzle includes a fillpipe sealing device and internal conduit positioned in such a manner as to enable free-flow of liquid and recovery of vapors displaced during the gravity transfer of liquids to other containers as well as automatic shutoff of liquid transfer when the receiving container is full to prevent overfill and spillage of liquid.

12 Claims, 1 Drawing Sheet

PORTABLE LIQUID TRANSFER CONTAINER AND DISPENSING NOZZLE WITH NON-MOVABLE PART FREE FLOW, VAPOR RECOVERY AND OVERFILL PREVENTION SYSTEM

BACKGROUND OF THE INVENTION

Portable liquid containers are used for transfer of a variety of liquids to other containers. Possibly the most widespread example is transfer of gasoline to many household devices with small internal combustion engines such as lawnmowers, chain saws and leaf blowers. The design of such devices has historically been composed of a rigid container, equipped with a manually opened vent, which enables free-flow of the liquid during gravity transfer through a dispensing nozzle.

During the gravity transfer of volatile liquids, such as gasoline from portable containers, hazardous vapors are displaced from the receiving container and released in the breathing zone of the person doing the transfer. These vapors ultimately disperse into the entire atmosphere. Frequently, the liquid is spilled from overfill, creating additional potential hazards as well as further exposing the person to toxic and hazardous chemicals and polluting the atmosphere.

While advancements have been made to recover vapors and prevent overfills from refueling of motor vehicles at gasoline service station pumps through use of automatic mechanical shutoff valves as disclosed in U.S. Pat. No. 5,307,848 and vapor return passages on the pressurized nozzles connected to stationary underground gasoline service station tanks as disclosed in U.S. Pat. No. 5,255,723 and U.S. Pat. No. 4,505.308, the only advancement in the liquid transfer function of portable liquid containers have been a manual pressurized fuel transfer container as disclosed in U.S. Pat. No. 5,244,021 and accessory dispensing nozzles for gravity flow containers with moving part systems that include manually actuated shut off valves as disclosed in U.S. Pat. No. 5,076,333. These devices have not see widespread application, possibly due to their inconvenience of use or relatively high cost in relation to traditional container costs.

It would be desirable, therefore, to have a portable liquid container using gravity fill principals that provides a simple to use and cheap to construct system with non-movable parts which automatically provides free flow and recovers vapors released during the transfer of liquids as well as prevents spills from overfills in order to improve on ease of use and protect the health and safety of the person transferring the liquid as well as to protect the atmosphere from pollution.

SUMMARY OF THE INVENTION

The present invention comprises a dispensing nozzle with receiving container fillpipe seal, an airtight portable container and an internal conduit. The fillpipe seal prevents the release to the atmosphere of vapors displaced from the container being gravity filled. The internal conduit extending from the top tip of the dispensing nozzle into the top and back of the container above the liquid fill level provides an unrestricted pathway to allow rapid transfer of vapors displaced from the receiving container into the subject container by pressure built up from the liquid entering the receiving container and vacuum created from the transfer of the liquid from the subject container. By equalizing the pressure between the two containers, the internal conduit also provides for free flow of liquid from the subject container into the receiving container. The internal conduit is positioned and fastened on the top and end of the dispensing nozzle with fillets to enable laminar flow of the liquid passing through the dispensing nozzle, which minimizes generation of vapors and minimizes possibilities of liquid being sucked into the internal conduit, which would disable its function. The dispensing nozzle is connected to the container with an air tight threaded cap. The container provides a threaded opening on the front for filling and for attaching the dispensing nozzle and an internal support for the conduit to keep it above the liquid fill line of the container and directed toward the back of the container so it will not fill with liquid when the container is at rest or tipped for liquid transfer, which would disable its function. The threaded fillpipe opening is positioned so its bottom outside lip, which defines the fill line, is below the conduit support to insure liquid does not enter the conduit, which would disable its function.

Liquid transfer is initiated by inserting the dispensing nozzle in the fillpipe of the receiving container, pressing the vapor seal against the fillpipe lip and then lifting and tilting the container. When liquid level in the receiving container reaches the tip of the dispensing nozzle, the internal conduit and dispensing nozzle ends are automatically and simultaneously sealed by the liquid creating an instant vacuum in the subject container which automatically stops the flow of liquid into the receiving container, thereby preventing overfill and spillage. After the liquid has ceased flowing, the container is lowered while the fillpipe seal remains held in contact with the receiving container fillpipe. The dispensing nozzle can then be removed from the receiving container without any spillage of liquid that may have remained in the dispensing nozzle as this small amount of liquid will have drained into the receiving container..

The subject container enables further reduction of air pollution when used for gasoline transfer by discharging recovered vapors into a gasoline service station fuel pump nozzle equipped with a vapor recovery system when the container is refilled, thereby completing a totally closed-loop transfer system for a very hazardous, toxic and polluting liquid and vapor.

DETAILED DESCRIPTION OF THE INVENTION

Figures 1, 2, 3:
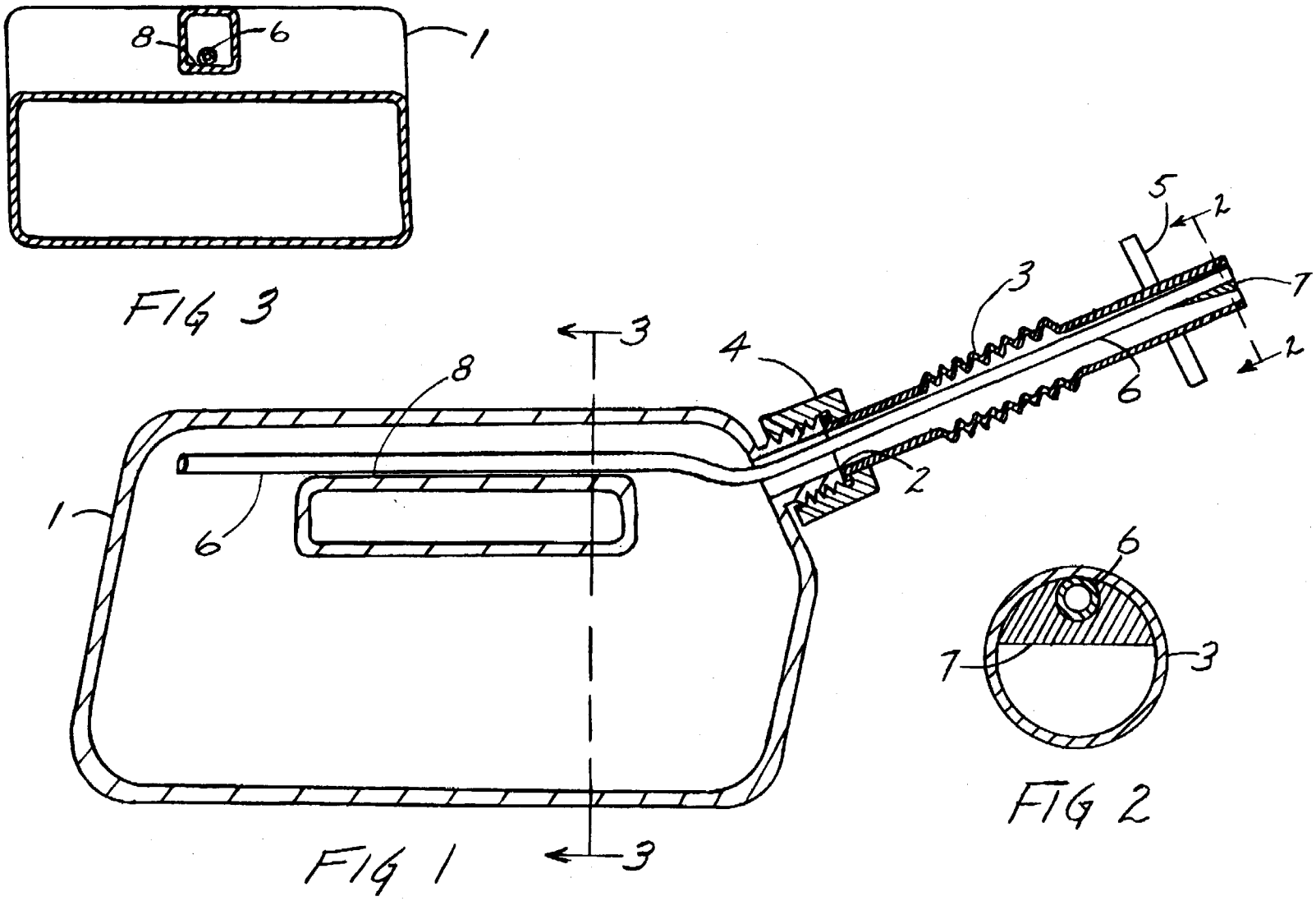
FIG. 1 presents a side elevation with the parts in section of the container, dispensing nozzle and internal conduit and fillpipe sealing member.
FIG. 2 presents a section of the dispensing nozzle and internal conduit.
FIG. 3 presents a section of the container including the internal conduit and its support shelf.

FIG. 1 shows an air tight rigid container 1 generally rectangular and typically in the one to two gallon size with a threaded fillpipe 2 for filling and for fastening the flexible dispensing nozzle 3 which has an inside diameter suitable for most fillpipes, typically ⅝ inches. A threaded air tight cap 4 is used to attach the dispensing nozzle 3 to the container 1. A semi-rigid flat fillpipe seal 5, approximately two inches in diameter, is made of a material such as rubber and attached to the dispensing nozzle 3 about 1½ inches from its end. A flexible internal conduit 6 about 3/16 inch inside diameter and 5/16 inch outside diameter is attached to the dispensing nozzle 3 at its top end with fillets 7 extending to about one-half of the dispensing nozzle opening and tapered back about one inch as shown in FIG. 1 and FIG. 2.

The fillet can be made of any suitable material such as silicon sealer. The inernal conduit 6 extends from the top tip of the dispensing nozzle through the nozzle and into the top and back of the container as shown in FIG. 1. The internal conduit 6 is guided and held in position in the top of the container 1 by a support shelf 8, in this case the bottom of a hollow container carrying handle 9, as shown in FIG. 3. The bottom outside lip of the threaded container fillpipe 2 is positioned below the support shelf 8.

It will be clear from the foregoing that the present invention is expected to find its primary utility in the recovery of vapors and prevention of overfills from the free flow, gravity transfer of gasoline from portable containers. However, it will be understood by those skilled in the art that it may also advantageously be applied to the free flow, recovery of vapors and the prevention of overfills separately or in various combinations for the safe transfer of any liquid from portable containers.

What is claimed is:

1. In combination:

a portable dispensing container having an exterior which defines a forward region, a back opposite the forward region, a top and a bottom on which the container rests in a normal upright orientation, and the container also having a neck at the forward region of the container and an interior wall member near the top of the container, and a nozzle attachable to the neck of the container for gravity transfer of liquid from the container by tilting the container forward from the normal upright orientation to a dispensing orientation, the nozzle comprising a flexible outer sleeve defining a passage for flow of liquid from the container and a flexible internal conduit mounted in the outer sleeve and extending toward the back of the container above the interior wall member, the flexible internal conduit having an inner end which is above the surface of liquid in the container both when the container is in its normal upright orientation and when it is in its dispensing orientation, and wherein the combination has no moving parts.

2. A combination according to claim 1, wherein the outer sleeve has an inner end at which it is attachable to the neck of the container and also has an opposite outer end, and the flexible internal conduit has an outer end which is substantially flush with the outer end of the outer sleeve.

3. A combination according to claim 1, comprising a semi-rigid vapor seal attached to the nozzle for engaging a fill pipe of a receiving container in order to prevent escape of vapor from the receiving container into the atmosphere.

4. A combination according to claim 1, wherein the flexible internal conduit is attached to the outer sleeve near an outer end thereof by means of at least one fillet in order to maintain laminar flow of liquid through the outer sleeve.

5. A combination according to claim 1, wherein the interior wall member is part of a handle structure.

6. In combination:

a portable dispensing container having an exterior which defines a forward region, a back opposite the forward region, a top and a bottom on which the container rests in a normal upright orientation, and the container also having a threaded neck at the forward region of the container and a hollow handle structure near the top of the container, and a nozzle attachable to the neck of the container for gravity transfer of liquid from the container by tilting the container forward from the normal upright orientation to a dispensing orientation, the nozzle comprising a flexible outer sleeve defining a passage for flow of liquid from the container and a flexible internal conduit mounted in the outer sleeve and extending toward the back of the container through the hollow handle structure, the flexible internal conduit having an inner end which is above the surface of liquid in the container both when the container is in its normal upright orientation and when it is in its dispensing orientation and having an outer end which is substantially flush with an outer end of the nozzle, and wherein the combination has no moving parts.

7. A combination according to claim 6, comprising a semi-rigid vapor seal attached to the nozzle for engaging a fill pipe of a receiving container in order to prevent escape of vapor from the receiving container into the atmosphere.

8. A combination according to claim 6, wherein the flexible internal conduit is attached to the outer sleeve near an outer end thereof by means of at least one fillet in order to maintain laminar flow of liquid through the nozzle.

9. In combination:

a portable dispensing container defining a main chamber for receiving liquid to be dispensed, the container having an exterior which defines a forward region, a back opposite the forward region, a top and a bottom on which the container rests in a normal upright orientation, and the container also having a threaded neck at the forward region of the container and a handle structure near the top of the container, the handle structure being hollow and in open communication with the main chamber, and a nozzle attached to the neck of the container for gravity transfer of liquid from the container by tilting the container forward from the normal upright orientation to a dispensing orientation, the nozzle comprising a flexible outer sleeve defining a passage for flow of liquid from the container and a flexible internal conduit mounted in the outer sleeve and extending toward the back of the container through the hollow handle structure, the flexible internal conduit having an inner end which is above the surface of liquid in the container both when the container is in its normal upright orientation and when it is in its dispensing orientation, and wherein the combination has no moving parts.

10. A combination according to claim 9, wherein the flexible internal conduit has an outer end which is substantially flush with an outer end of the nozzle.

11. A combination according to claim 9, comprising a semi-rigid vapor seal attached to the nozzle for engaging a fill pipe of a receiving container in order to prevent escape of vapor from the receiving container into the atmosphere.

12. A combination according to claim 9, wherein the flexible internal conduit is attached to the outer sleeve near an outer end thereof by means of at least one fillet in order to maintain laminar flow of liquid through the outer sleeve.

* * * * *